US010907655B2

(12) United States Patent
Sakoda et al.

(10) Patent No.: US 10,907,655 B2
(45) Date of Patent: Feb. 2, 2021

(54) MULTIBLADE FAN

(71) Applicant: Mitsubishi Electric Corporation, Chiyoda-ku (JP)

(72) Inventors: Kenichi Sakoda, Chiyoda-ku (JP); Kazuki Okamoto, Chiyoda-ku (JP); Hitoshi Kikuchi, Chiyoda-ku (JP); Kenta Okeya, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/341,311

(22) PCT Filed: Apr. 24, 2017

(86) PCT No.: PCT/JP2017/016193
§ 371 (c)(1),
(2) Date: Apr. 11, 2019

(87) PCT Pub. No.: WO2018/116498
PCT Pub. Date: Jun. 28, 2018

(65) Prior Publication Data

US 2019/0353183 A1 Nov. 21, 2019

(30) Foreign Application Priority Data

Dec. 20, 2016 (JP) ..... 2016-246071

(51) Int. Cl.
*F04D 29/68* (2006.01)
*F04D 17/16* (2006.01)
*F04D 29/66* (2006.01)

(52) U.S. Cl.
CPC ..... *F04D 29/667* (2013.01); *F04D 17/16* (2013.01)

(58) Field of Classification Search
CPC ..... F04D 29/4213; F04D 29/4226; F04D 29/661; F04D 29/667; F04D 29/4233; F04D 29/422; F04D 29/424
See application file for complete search history.

(56) References Cited

U.S. PATENT DOCUMENTS 3,289,598 A * 12/1966 Buse ..... F04D 29/445 415/205
8,419,360 B2 * 4/2013 Yamasaki ..... F04D 29/282 415/206

(Continued)

FOREIGN PATENT DOCUMENTS

CN 204532956 U 8/2015
DE 102009033773 A1 1/2011

(Continued)

OTHER PUBLICATIONS

Extended European Search Report dated Nov. 21, 2019 in European Patent Application No. 17884903.0, citing document AO therein, 6 pages.

(Continued)

*Primary Examiner* — Justin D Seabe
(74) *Attorney, Agent, or Firm* — Xsensus LLP

(57) ABSTRACT

A multiblade fan includes an impeller including a rotating plate and blades and further includes a fan casing having a circumferential wall and a first end face disposed adjacent to distal ends of the blades. The first end face has an inlet. The multiblade fan further includes a duct and a flow regulating block disposed on an inner surface of the first end face. The flow regulating block regulates a flow of the air. The duct includes a diffuser plate. The circumferential wall includes a tongue that is connected to the diffuser plate. The first end face has a bell mouth provided at the inlet. The flow regulating block is spaced from the circumferential wall and extends along the bell mouth in the rotation direction such (Continued)

that the flow regulating block is located in a range of 120 degrees from a reference position on a line connecting the rotary shaft to a tip of the tongue.

10 Claims, 6 Drawing Sheets

(56) References Cited

U.S. PATENT DOCUMENTS

| | | | | |
|---|---|---|---|---|
| 9,447,792 | B2 * | 9/2016 | Mitsuishi | F04D 17/16 |
| 2012/0009059 | A1 * | 1/2012 | Okamoto | F04D 29/441 415/224 |

FOREIGN PATENT DOCUMENTS

| | | | |
|---|---|---|---|
| EP | 2 275 687 | A2 | 1/2011 |
| JP | 64-11399 | U | 1/1989 |
| JP | 2005-201095 | A | 7/2005 |

OTHER PUBLICATIONS

International Search Report dated Jun. 13, 2017 in PCT/JP2017/016193 filed Apr. 24, 2017.
Office Action dated Apr. 13, 2020, issued in corresponding Chinese Patent Application No. 201780077659.9, with English Translation.

* cited by examiner

MULTIBLADE FAN

TECHNICAL FIELD

The present invention relates to a multiblade fan including a fan casing and an impeller contained in the fan casing.

BACKGROUND ART

A multiblade fan, also referred to as a sirocco fan, is a device that pressurizes air taken through an inlet and discharges the pressurized air through an outlet by using a centrifugal force applied to the air through an impeller rotating in a fan casing. Such a fan is used in a ventilation duct of, for example, a factory or a building, an apparatus for causing air to enter and circulate in a space under a floor of, for example, a house, or an apparatus for ventilating an indoor space, such as a kitchen or a cooking area. The impeller typically includes a rotating plate and a plurality of blades extending from adjacent to an outer edge of the rotating plate. The air taken through the inlet flows into a space surrounded by the blades and the rotating plate and is sent out of the space through the spacing between the blades outwardly in a radial direction of the impeller while being pressurized by a centrifugal force. The air sent out of the impeller passes through a space between the impeller and the fan casing, flows into a duct connected to the fan casing, and is then discharged through the outlet. The fan casing includes a tongue inwardly bent near the impeller, and is connected to a wall of the duct by the tongue.

The velocity of the air flowing through the duct is not uniform. For example, the velocity of the air flowing adjacent to the rotating plate is high, and that of the air flowing adjacent to the inlet is low. Furthermore, the air tends to experience turbulence in a duct inflow port because the duct is an air guiding branch. In particular, in the vicinity of the tongue, such turbulence of air flow may cause part of the air that has flowed through the fan casing to return to or reenter the fan casing and be again circulated without flowing through the duct to the outlet, thus degrading air-sending performance of the multiblade fan. To prevent an air flow from reentering the fan casing through a space between the tongue and the impeller, a fan known in the art is configured such that at the duct, a portion of wall connected to the tongue has wall protrusions protruding toward the impeller in a direction inverse to a rotation direction of the impeller (refer to Patent Literature 1, for example).

CITATION LIST

Patent Literature

Patent Literature 1: Japanese Unexamined Patent Application Publication No. 2005-201095

SUMMARY OF INVENTION

Technical Problem

As described above, multiblade fans are used in apparatuses for causing air circulation in a place under relatively high static pressure. Under such conditions, the difference in pressure between a duct, serving as a high-pressure side, of a multiblade fan and the vicinity of a tongue, serving as a low-pressure side, of a fan casing is large. If the duct has wall protrusions like the duct of the fan disclosed in Patent Literature 1, an air flow may fail to resist the pressure difference between the duct and the tongue, causing part of the air flow to reenter the fan casing through a space between an impeller and the wall protrusions. Such a reentering flow may again pass by the impeller and interfere with the impeller, thus degrading the air-sending performance of the multiblade fan.

In the configuration in which the wall protrusions of the duct connected to the tongue protrude into the duct where the air flows at a high velocity, as in Patent Literature 1, the wall protrusions interfere with the air flowing through the duct, causing pressure loss. This results in degraded air-sending performance. In particular, if the multiblade fan having such a configuration is installed in a place under relatively high static pressure, the pressure loss caused by the interference between the wall protrusions and the air flow through the duct will markedly increase because a main stream of the air flow through the duct passes adjacent to the impeller. Under such high static pressure conditions, the wall protrusions intended to prevent such a reentering flow may degrade the air-sending performance of the multiblade fan.

The present invention has been made to overcome the above-described problem, and aims to provide a multiblade fan that exhibits good air-sending performance under high static pressure conditions.

Solution to Problem

A multiblade fan according to an embodiment of the present invention includes an impeller including a rotating plate secured to a rotary shaft and a plurality of blades extending from a surface of the rotating plate and circumferentially spaced about the rotary shaft, and further includes a fan casing containing the impeller and having a circumferential wall facing a periphery of the impeller and a first end face disposed adjacent to distal ends of the plurality of blades. The circumferential wall extends at an increasing distance from the rotary shaft in a rotation direction of the impeller. The first end face has an inlet through which air flows into the fan casing. The multiblade fan further includes a duct connected to a downstream end of the fan casing in an air flow direction and having an outlet through which the air from the fan casing is discharged. The multiblade fan further includes a flow regulating block disposed on an inner surface of the first end face and regulating a flow of the air. The duct includes a diffuser plate extending from an upstream end of the circumferential wall in the air flow direction. The diffuser plate extends in the rotation direction outwardly in a radial direction of the impeller. The circumferential wall includes a tongue that is bent part of the upstream end. The tongue is connected to the diffuser plate. The first end face has a bell mouth provided at the inlet and protruding into the fan casing. The flow regulating block is spaced from the circumferential wall and extends along the bell mouth in the rotation direction such that the flow regulating block is located in a range of 120 degrees from a reference position on a line connecting the rotary shaft to a tip of the tongue.

Advantageous Effects of Invention

According to the embodiment of the present invention, an air flow, serving as part of an air flow that has passed through the impeller and that is guided toward the duct by the fan casing, reentering the fan casing through a space between the tongue and the impeller can be guided into a space between the flow regulating block and the circumferential wall. Therefore, the multiblade fan can reduce a degradation in air-sending performance caused by interference between the air flow reentering the fan casing and the impeller in a duct inflow port. Thus, the multiblade fan can exhibit good air-sending performance under high static pressure conditions.

DESCRIPTION OF EMBODIMENTS

Embodiment 1

Figure 1:
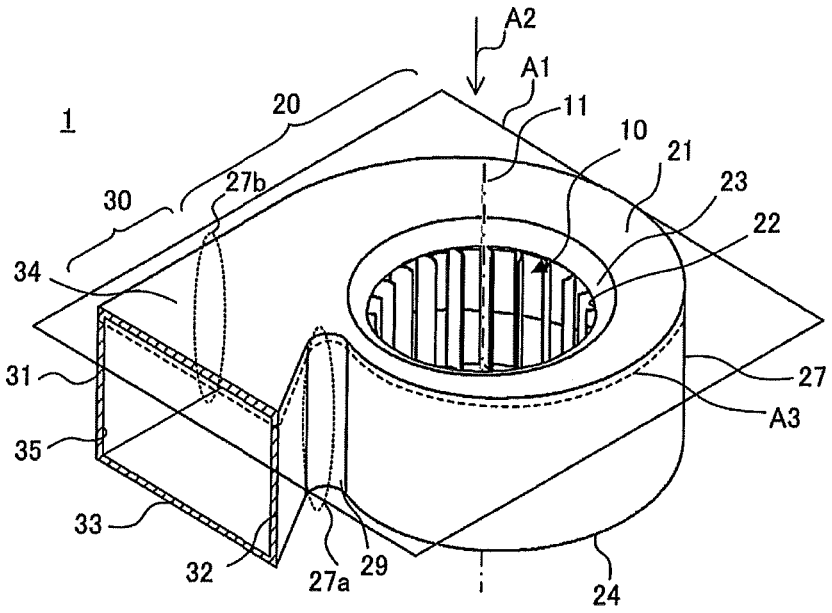
FIG. 1 is a perspective view of a multiblade fan according to Embodiment 1 of the present invention.
Figure 2:
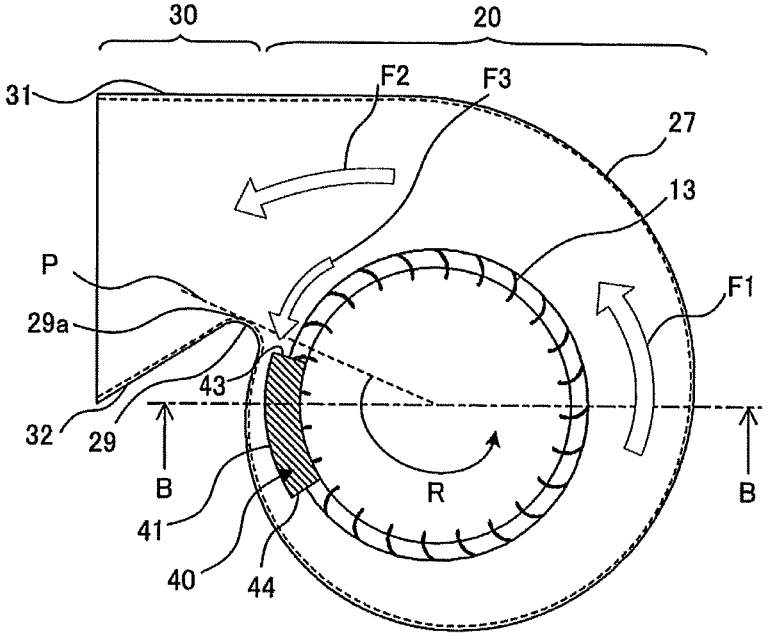
FIG. 2 is a cross-sectional view of the multiblade fan taken along plane A1 in FIG. 1.
Figure 3:
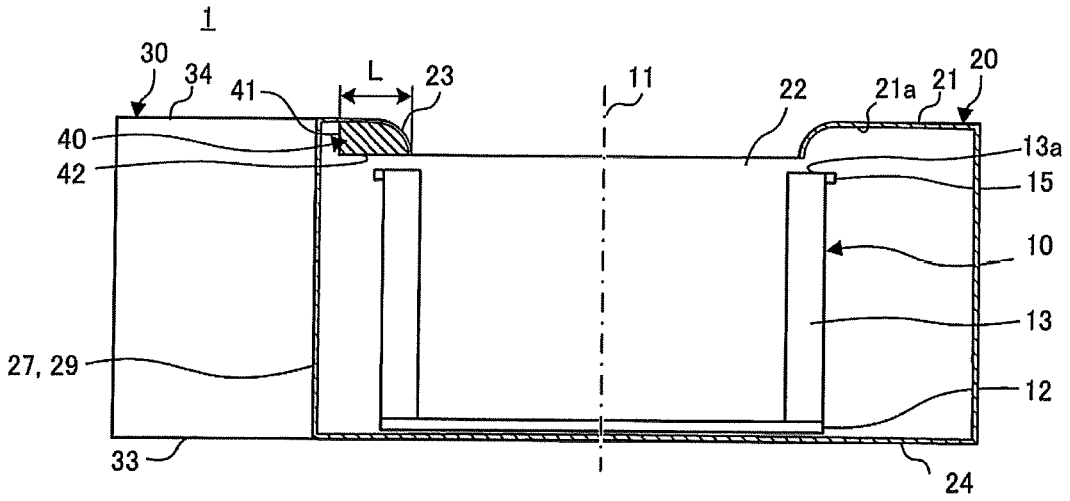
FIG. 3 is a longitudinal sectional view of the multiblade fan taken along line B-B in FIG. 2.

The configuration of a multiblade fan 1 will be described with reference to FIGS. 1 to 3. FIG. 1 is a perspective view of the multiblade fan according to Embodiment 1 of the present invention. FIG. 2 is a cross-sectional view of the multiblade fan taken along plane A1 in FIG. 1. FIG. 2 illustrates a cross-section of the multiblade fan 1 taken at a position represented by dotted line A3 as viewed in a direction represented by arrow A2 in FIG. 1. FIG. 3 is a longitudinal sectional view of the multiblade fan taken along line B-B in FIG. 2.

The multiblade fan 1 is a device that causes air taken through an inlet 22 to flow through the fan by pressurizing the air and discharging the air through an outlet 35. The multiblade fan 1 includes an impeller 10, a fan casing 20 containing the impeller 10, and a duct 30 connected to the fan casing 20.

The impeller 10 is rotated and driven by, for example, a motor (not illustrated), and causes the air to be sent outwardly in a radial direction of the impeller by using a centrifugal force generated by rotation. As illustrated in FIG. 3, the impeller 10 includes a rotating plate 12 and a plurality of blades 13. The rotating plate 12 is secured to a rotary shaft 11 of the motor, and is capable of rotating about the rotary shaft 11. For example, the rotating plate 12 is disk-shaped. The blades 13 are circumferentially arranged about the rotary shaft 11. The blades 13 each have a proximal end secured to a surface of the rotating plate 12 and a distal end 13*a* facing the inlet 22. The blades 13 are arranged at regular intervals near an outer edge of the rotating plate 12. For example, the blades 13 each have a curved cross-section and a rectangular plate-like shape. The blades 13 are arranged radially or obliquely at a predetermined angle in the radial direction.

Parts of the blades 13 adjacent to the inlet 22, or the distal ends 13*a*, are coupled to each other by a coupler 15. The coupler 15 couples the blades 13 together to maintain the positional relationship between the distal ends 13*a* of the blades 13 and strengthen the blades 13. For example, the coupler 15 may be a ring-shaped part that is disposed around the blades 13 and with which the blades 13 are combined together or may be a ring-shaped plate having substantially the same width as that of the distal ends 13*a* and coupling the distal ends 13*a* of the blades 13 together.

Rotating the impeller 10 having the above-described configuration causes the air taken into a space surrounded by the rotating plate 12 and the blades 13 to be radially outwardly sent out of the impeller through the spacing between the blades 13. Although each blade 13 extends substantially perpendicular to the rotating plate 12 in Embodiment 1, the arrangement of the blades 13 is not limited to such an example. The blades 13 may be inclined relative to a direction perpendicular to the rotating plate 12.

The fan casing 20 is a scroll type fan casing. The fan casing 20 is, for example, a hollow cylinder having therein a substantially cylindrical space, and surrounds substantially the whole of the impeller 10. The fan casing 20 has a first end face 21 and a second end face 24, which extend orthogonal to the rotary shaft 11 and are opposite each other, and further has a circumferential wall 27 connecting an outer edge of the first end face 21 to an outer edge of the second end face 24 and facing the periphery of the impeller 10. The first end face 21 is located adjacent to the distal ends 13*a* of the blades 13. The second end face 24 is located adjacent to the rotating plate 12.

The first end face 21 has the inlet 22 to enable air circulation between the impeller 10 and the outside of the fan casing 20. The inlet 22 is formed by a bell mouth 23 protruding into the fan casing 20. As illustrated in FIGS. 1 and 3, the bell mouth 23 reduces its opening diameter gradually toward the inside of the fan casing 20. The inlet 22, which is circular, is substantially axially aligned with the rotary shaft 11 in the impeller 10. Such a configuration allows the air to smoothly flow near the inlet 22 and efficiently flow into the impeller 10 through the inlet 22.

Referring to FIG. 2, the circumferential wall 27 has a substantially Archimedean spiral shape such that the distance between the circumferential wall 27 and the rotary shaft 11 gradually increases in a rotation direction (represented by arrow R) of the impeller 10. Specifically, the space between the circumferential wall 27 and the periphery of the impeller 10 increases in a direction from a tongue 29, which will be described later, to the duct 30 at a predetermined rate, and the area of an air passage also gradually increases in the direction from the tongue 29 to the duct 30. Such a shape allows the air sent out of the impeller 10 to smoothly flow through the space between the impeller 10 and the circumferential wall 27 in a direction represented by arrow Fl in FIG. 2. This results in an efficient rise in static pressure in the air passage extending from the tongue 29 to the duct 30 in the fan casing 20.

The duct 30 is a tube having a rectangular cross-section in a direction orthogonal to an air flow direction in which the air flows along the circumferential wall 27. Referring to FIG. 2, the duct 30 defines a passage through which the air sent out of the impeller 10 and flowing through the space between the circumferential wall 27 and the impeller 10 is guided and discharged into outdoor air. The duct 30 has a first end secured to the fan casing 20. The first end serves as a duct inflow port through which the air flows from the fan casing 20 into the duct 30. The duct 30 has a second end, serving as the outlet 35 through which the air that has flowed through the passage in the duct 30 is discharged into the outdoor air. In FIG. 2, arrow F2 represents the air flowing from the fan casing 20 toward the outlet 35 of the duct 30.

As illustrated in FIG. 1, the duct 30 includes an extension plate 31, a diffuser plate 32, a duct bottom plate 33, and a duct top plate 34. The extension plate 31 is smoothly connected to a downstream end 27*b* of the circumferential wall 27 in the air flow direction and is integrated with the fan casing 20. The diffuser plate 32 is connected to an upstream end 27*a* of the circumferential wall 27 in the air flow direction, and is disposed at a predetermined angle with respect to the extension plate 31 such that the cross-sectional area of the passage gradually increases in the air flow direction in the duct 30. In other words, the diffuser plate 32 extends from the upstream end 27*a* of the circumferential wall 27 and extends in the rotation direction (represented by the arrow R) of the impeller 10 radially outward. The duct top plate 34 is connected to the first end face 21 of the fan casing 20. The duct bottom plate 33 is connected to the second end face 24 of the fan casing 20. The duct top plate 34 and the duct bottom plate 33 facing each other are connected by the extension plate 31 and the diffuser plate 32. The extension plate 31, the diffuser plate 32, the duct bottom plate 33, and the duct top plate 34, which are arranged as described above, define the passage having a rectangular cross-section.

The circumferential wall 27 of the fan casing 20 includes the tongue 29 located at the upstream end 27*a* connected to the diffuser plate 32. The tongue 29 is bent and protrudes into the passage in the duct inflow port. The tongue 29 has a predetermined radius of curvature. The circumferential wall 27 is smoothly connected to the diffuser plate 32 by the tongue 29 extending between the second end face 24 and the first end face 21. When the air taken through the inlet 22 into the impeller 10, sent out of the impeller 10, and gathered by the fan casing 20 flows into the duct 30, the tongue 29 serves as a branch point in the passage. Specifically, the passage (represented by the arrow F2) to the outlet 35 and a passage (represented by arrow F3) through which the air reenters an upstream region from the tongue 29 are formed at the duct inflow port. The air increases in static pressure while flowing through the fan casing 20, so that the air flowing into the duct 30 has a pressure higher than that in the fan casing 20. The tongue 29 functions to maintain such a pressure difference, and further functions to guide the air flowing toward the duct 30 into each passage because of its curved surface. If the air flowing toward the duct 30 hits the tongue 29, the tongue 29 having the above-described shape can minimize turbulence of the air flow. This prevents a degradation in the air-sending performance of the multiblade fan 1 and an increase in noise level in the multiblade fan 1. Although the radius of curvature of the tongue 29 is constant along the rotary shaft 11 in Embodiment 1, the radius of curvature of the tongue 29 is not limited to this example. The tongue 29 may be shaped such that, for example, the radius of curvature of the tongue 29 adjacent to the first end face 21 having the inlet 22 is greater than that adjacent to the second end face 24.

The multiblade fan 1 further includes a flow regulating block 40 for regulating the flow of air in the vicinity of the tongue 29. FIG. 2 illustrates a plane (reference line P representing a section of the plane in FIG. 2) that includes the rotary shaft 11, extends through the rotary shaft 11, and is tangent to a tip 29*a* of the tongue 29 in the fan casing 20. The flow regulating block 40 is provided downstream of the reference line P in the air flow direction, or forward of the reference line P in the rotation direction, such that the flow regulating block 40 is located in a range of a predetermined angle from the reference line P. Furthermore, the flow regulating block 40 is disposed in a space defined by the distal ends 13*a* of the blades 13 and an inner surface 21*a* of the first end face 21, as illustrated in FIG. 3. The flow regulating block 40 is fastened to and in tight contact with the first end face 21, particularly, the bell mouth 23, which is curved. The flow regulating block 40 has a dimension along the rotary shaft 11, and this dimension is substantially equal to the distance between the inner surface 21*a* and a downstream end of the bell mouth 23 in the air flow direction. In other words, the flow regulating block 40 has a block bottom surface 42 facing the distal ends 13*a* of the blades 13, and the block bottom surface 42 is smoothly connected to the downstream end of the bell mouth 23. The flow regulating block 40 further has a block side wall 41 facing radially outward, and the block side wall 41 is spaced from the circumferential wall 27 of the fan casing 20. In Embodiment 1, the flow regulating block 40 has substantially identical cross-sections, taken along planes obtained by rotating the plane represented by the reference line P in FIG. 2 in the arrow R direction, regardless of the angle of rotation. The flow regulating block 40 may have any shape. For example, the block bottom surface 42 may extend along a plane orthogonal to the rotary shaft 11. If the distal ends 13*a* of the blades 13 slope radially, the block bottom surface 42 may slope such that the distance between the block bottom surface 42 and the distal ends 13*a* is constant.

Air flow during operation of the multiblade fan 1 will now be described. When the impeller 10 rotates, the air inside the impeller 10 is sent radially outward by a centrifugal force generated by rotation of the impeller 10 and the air near the inlet 22 is guided into the impeller 10 by the bell mouth 23. A suction flow of the air sent out of the impeller 10 moves along the circumferential wall 27 of the fan casing 20 in the rotation direction (arrow R direction) of the impeller 10. Since the cross-sectional area of the passage between the circumferential wall 27 of the fan casing 20 and the impeller 10 gradually increases in the arrow R direction away from the vicinity of the tongue 29, the static pressure of the air flowing through the fan casing 20 gradually increases. Most of the air that has increased in static pressure and has reached the duct inflow port flows through the duct 30 and is discharged through the outlet 35, as represented by the arrow F2. The tongue 29 is located in the duct inflow port, and the static pressure is lowest in the vicinity of the tongue 29 in the fan casing 20. This causes an air flow directed from the duct 30, serving as a high-pressure side, to the tongue 29, serving as a low-pressure side, as represented by the arrow F3. For a main stream through the duct 30, a main-stream component adjacent to the duct top plate 34, or adjacent to the inlet 22, in a direction along the rotary shaft 11 flows at a velocity lower than that of a main-stream component adjacent to the duct bottom plate 33, or adjacent to the rotating plate 12. Therefore, the air flow from the duct 30 to the tongue 29 often occurs adjacent to the inlet 22 rather than adjacent to the rotating plate 12. The air flow generated adjacent to the inlet 22 in the duct 30 and moving to the tongue 29 passes through the space defined by the block side wall 41 and the circumferential wall 27 including the tongue 29 and reenters the fan casing 20. In other words, the reentering flow (represented by the arrow F3) generated adjacent to the duct top plate 34 and moving from the duct 30 to the tongue 29 has no influence on the air flow through the impeller 10 in the vicinity of the tongue 29. Therefore, the multiblade fan 1 can reduce mixing loss due to interference between the reentering flow and the suction flow as well as the turbulence of the air flow, thus reducing energy loss in the passage in the fan casing 20. The flow regulating block 40, which is disposed forward of the tongue 29 in the rotation direction (arrow R direction), does not interfere with any high-velocity air flow through the duct 30, and thus causes no pressure loss due to interference.

As described above, the multiblade fan 1 can reduce pressure loss due to the interference between the reentering flow and the suction flow, thus increasing a static pressure that the multiblade fan 1 can generate. Furthermore, the multiblade fan 1 can prevent noise resulting from the interference between the reentering flow and the suction flow. Therefore, if the multiblade fan 1 is installed in a place under high static pressure, for example, a ventilation duct, the multiblade fan 1 can provide an intended air flow rate without reducing the flow rate and increasing a noise level.

Figure 4:
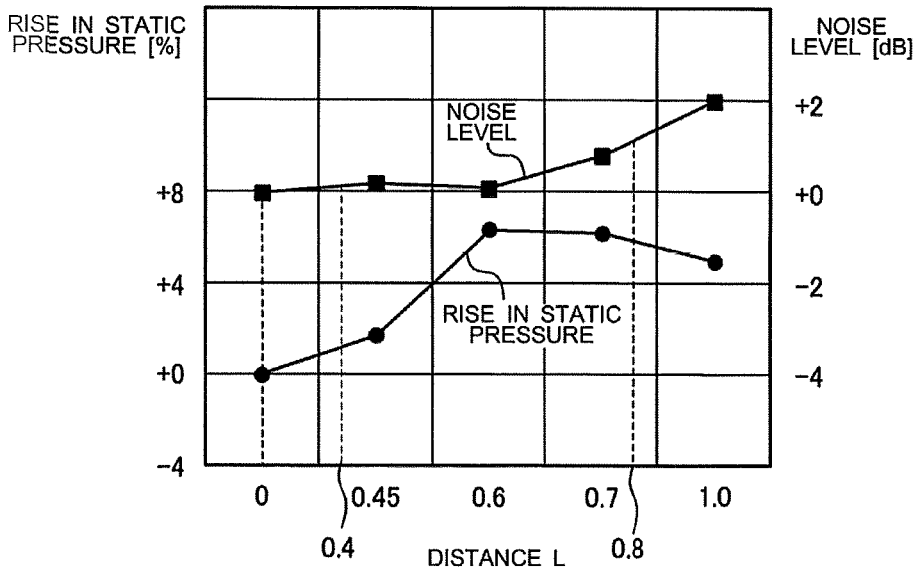
FIG. 4 is a graph showing the relation between the width of a flow regulating block in Embodiment 1 of the present invention, a rise in static pressure, and a noise level.

FIG. 4 is a graph showing the relation between the width of the flow regulating block in Embodiment 1 of the present invention, a rise in static pressure, and a noise level. FIG. 4 shows results obtained by testing the above-described effects under externally applied high static pressure by experiment. The horizontal axis of FIG. 4 represents a distance L, illustrated in FIG. 3, representing the distance between the downstream end of the bell mouth 23 and the block side wall 41 in a direction perpendicular to the rotary shaft 11. The vertical axis of FIG. 4 represents a rise in static pressure and the noise level in the multiblade fan 1. The distance L is normalized by using the distance between the downstream end of the bell mouth 23 and the circumferential wall 27. For example, the distance L=0 means that the flow regulating block 40 was not provided, and the distance L=1 means that the flow regulating block 40 was provided in contact with the circumferential wall 27. For measurement, the flow regulating block 40 extended in the rotation direction (arrow R direction) over a range from an angle of 20 degrees form the reference line P and an angle of 70 degrees form the reference line P.

As illustrated in FIG. 4, a static pressure in the case where the flow regulating block 40 was provided (L>0) was higher than that in the case where the flow regulating block (L=0) was not provided. As the distance L associated with the flow regulating block 40 was longer, the noise level increased. The noise level reached a maximum value at the distance L=1. Such measurements demonstrate that the static pressure increased and an increase in noise level was suppressed at distances L ranging from 0.4 to 0.8. Therefore, the distance L associated with the flow regulating block 40 is preferably set in the range of 0.4 to 0.8.

Figure 5:
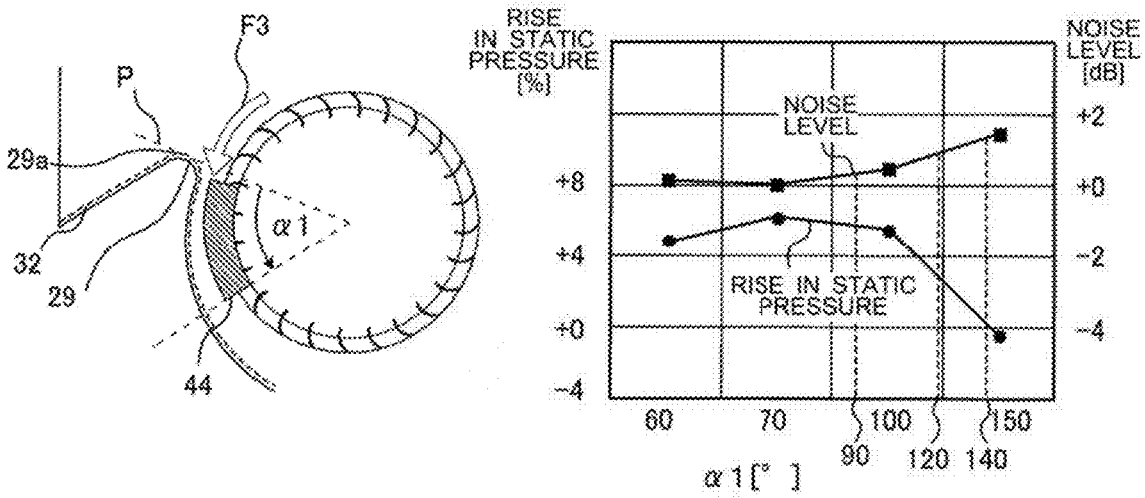
FIG. 5 includes diagrams showing the relation between the position of a trailing end of the flow regulating block in Embodiment 1 of the present invention, a rise in static pressure, and a noise level.

FIG. 5 includes diagrams showing the relation between the position of a trailing end of the flow regulating block in Embodiment 1 of the present invention, a rise in static pressure, and a noise level. FIG. 5 shows results obtained by testing the above-described effects of the multiblade fan 1 by experiment. The horizontal axis of FIG. 5 represents the attachment position of a downstream end (hereinafter, referred to as a trailing end 44) of the flow regulating block 40. The vertical axis of FIG. 5 represents a rise in static pressure and the noise level in the multiblade fan 1, as in FIG. 4. The horizontal axis further represents an angle $\alpha$1 representing the angle of rotation from the position of the reference line P, serving as a starting point, to the position of the trailing end 44 about the rotary shaft 11 in the arrow R direction, serving as a positive direction. For measurement, the flow regulating block 40 was spaced from the circumferential wall 27 such that the above-described distance L was 0.6, and an upstream end of the flow regulating block 40 was disposed at a position at which the angle of rotation from the reference line P in the rotation direction (arrow R direction) was 20 degrees.

As illustrated in FIG. 5, measurements associated with angles $\alpha$1 ranging from 60 to 150 degrees demonstrate that as the angle $\alpha$1 was greater, the noise level increased and a rise in static pressure tended to decrease. At angles $\alpha$1 up to approximately 140 degrees, rises in static pressure were positive values. Therefore, the trailing end 44 located at a position at 140 degrees or less enables the multiblade fan 1 to exhibit the effect of increasing the static pressure. Furthermore, a rise in static pressure of approximately 4% or more was advantageously obtained when the angle $\alpha$1 was set in the range of 60 to 120 degrees in consideration of an increase in noise level. In addition, when the angle $\alpha$1 was 100 degrees or less, the static pressure increased and an increase in noise level was suppressed. In particular, at angles $\alpha$1 around 70 degrees, for example, ranging from 60 to 90 degrees, a rise in static pressure was larger and an increase in noise level was smaller than those at angles $\alpha$1 other than the above-described range. Increasing the angle $\alpha$1 enhances the influence of reduction in cross-sectional area of the passage, thus canceling out the above-described effects obtained by disposing the flow regulating block 40. Therefore, the trailing end 44 is disposed in an attachment range of the flow regulating block 40 such that the angle $\alpha$1, or the angle of rotation from the reference line P to the trailing end 44, is preferably 120 degrees or less, more preferably, 100 degrees or less.

Figure 6:
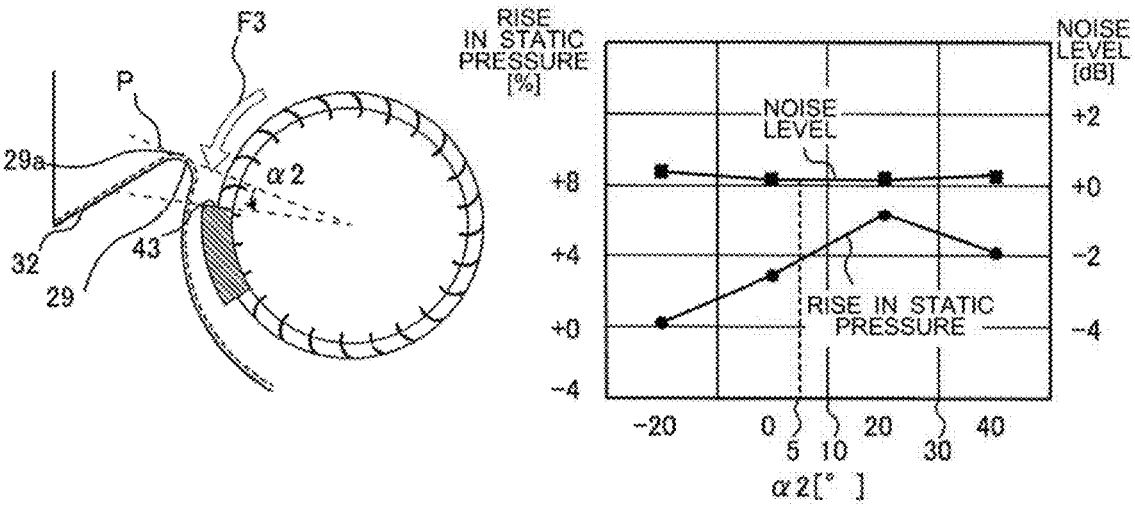
FIG. 6 includes diagrams showing the relation between the position of a leading end of the flow regulating block in Embodiment 1 of the present invention, a rise in static pressure, and a noise level.

FIG. 6 includes diagrams showing the relation between the position of a leading end of the flow regulating block in Embodiment 1 of the present invention, a rise in static pressure, and a noise level. FIG. 6 shows results obtained by testing the above-described effects of the multiblade fan 1 by experiment. The horizontal axis of FIG. 6 represents the attachment position of an upstream end (hereinafter, referred to as a leading end 43) of the flow regulating block 40. The vertical axis of FIG. 6 represents a rise in static pressure and the noise level in the multiblade fan 1, as in FIG. 4. The horizontal axis further represents an angle $\alpha$2 representing the angle of rotation from the position of the reference line P, serving as a starting point, to the position of the leading end 43 about the rotary shaft 11 in the arrow R direction, serving as a positive direction. For measurement, the flow regulating block 40 was spaced from the circumferential wall 27 such that the above-described distance L was 0.6, and the trailing end 44 of the flow regulating block 40 was disposed at a position at which the above-described angle $\alpha$1 was 70 degrees.

As illustrated in FIG. 6, measurements associated with angles $\alpha$2 ranging from negative 20 to positive 40 degrees demonstrate that changes in noise level were small but the noise level increased at an angle $\alpha$2 of negative 20 degrees. A rise in static pressure temporarily increased with increasing angle $\alpha$2. However, a rise in static pressure at an angle $\alpha$2 of positive 40 degrees was lower than that at an angle $\alpha$2 of positive 20 degrees. The measurements demonstrate that when the angle α2 was negative 20 degrees, the effect of increasing the static pressure was hardly observed and the noise level increased, and when the angle α2 was a positive value, the effect of increasing the static pressure was observed and an increase in noise level was suppressed. In particular, at angles α2 ranging from 10 to 30 degrees, rises in static pressure were large and increases in noise level were small. As described above, it is preferable not to dispose the flow regulating block 40 rearward (where the angle α2 is a negative value) of the reference line P, or a position closest to the tongue 29, in the rotation direction. This is because the air sent out of the impeller 10 flows radially forward in the rotation direction. Specifically, since the block side wall 41 and the circumferential wall 27 define a space therebetween, an air flow out of the impeller 10 at a position near the tongue 29 is pressed into the space by an air flow out of the impeller 10 at a position rearward of the tongue 29 in the rotation direction (for example, at a position at which the angle α2 is negative 20 degrees), thus increasing the static pressure. In the attachment range of the flow regulating block 40, therefore, the angle α2, or the angle of rotation from the reference line P to the leading end 43, is preferably set in the range of 0 degrees or more. Furthermore, when the angle α2 was set in the range of, for example, 5 to 40 degrees, such that the leading end 43 was located apart from the tongue 29, a rise in static pressure of approximately 4% or more was advantageously obtained.

As described above, the multiblade fan 1 according to Embodiment 1 includes the impeller 10 including the rotating plate 12 secured to the rotary shaft 11 and the blades 13 extending from one surface of the rotating plate 12 and circumferentially spaced about the rotary shaft 11, and further includes the fan casing 20 containing the impeller 10 and having the circumferential wall 27 facing the periphery of the impeller 10 and the first end face 21 disposed adjacent to the distal ends 13*a* of the blades 13. The circumferential wall 27 extends at an increasing distance from the rotary shaft 11 in the rotation direction of the impeller 10. The first end face 21 has the inlet 22 through which air flows into the fan casing. The multiblade fan further includes the duct 30 connected to the downstream end of the fan casing 20 in the air flow direction and having the outlet 35 through which the air from the fan casing 20 is discharged. The multiblade fan further includes the flow regulating block 40 disposed on the inner surface 21*a* of the first end face 21 and regulating a flow of the air. The duct 30 includes the diffuser plate 32 extending from the upstream end 27*a* of the circumferential wall 27 in the air flow direction. The diffuser plate 32 extends in the rotation direction (arrow R direction) outwardly in the radial direction of the impeller. The circumferential wall 27 includes the tongue 29 that is bent part of the upstream end 27*a*. The tongue 29 is connected to the diffuser plate 32. The first end face 21 has the bell mouth 23 disposed in the inlet 22 and protruding into the fan casing 20. The flow regulating block 40 is spaced from the circumferential wall 27 and extends along the bell mouth 23 in the rotation direction (arrow R direction) such that the flow regulating block is located in a range of 120 degrees from a reference position (reference line P) connecting the rotary shaft 11 to the tip 29*a* of the tongue 29.

Such a configuration of the multiblade fan 1 enables an air flow that is part of an air flow guided from the fan casing 20 into the duct 30 and that reenters the fan casing 20 through the space between the tongue 29 and the impeller 10 to be guided into the space between the flow regulating block 40 and the circumferential wall 27. Therefore, the multiblade fan 1 can prevent a degradation in fan performance caused by the interference between the reentering flow and the suction flow.

A typical multiblade fan may be incorporated in an air-conditioning apparatus including a heat exchanger and a dust collecting filter, and such an air-conditioning apparatus may be installed under a floor or a ventilation duct, for example. As described above, since the multiblade fan 1 according to Embodiment 1 can reduce energy loss in the fan casing 20 by reducing the interference between air flows, a static pressure that can be generated by the fan can be increased. Under high static pressure conditions, therefore, the multiblade fan 1 can provide an intended air flow rate while suppressing a reduction in flow rate and an increase in noise level.

The flow regulating block 40 has the leading end 43 close to the tongue 29 and the trailing end 44 remote from the tongue 29 such that the leading end 43 is in a range of an angle of 5 to 40 degrees from the reference position (reference line P) and the trailing end 44 is in a range of an angle of 60 to 120 degrees from the reference position (reference line P).

Such a configuration of the multiblade fan 1 enables the reentering air flow through the space between the tongue 29 and the impeller 10 to be guided into the space between the flow regulating block 40 and the circumferential wall 27 and stably flow. This leads to improved air-sending performance. In particular, the leading end 43 of the flow regulating block 40 is located downstream of the tongue 29. This arrangement allows an air flow that is sent out of the impeller 10 in the vicinity of the tongue 29 and that has a velocity component in the rotation direction to flow through the space between the flow regulating block 40 and the circumferential wall 27, thus increasing the static pressure in the multiblade fan 1. For example, the measurements in FIGS. 5 and 6 demonstrate that a rise in static pressure of approximately 4% or more was obtained.

Embodiment 2

Figure 7:
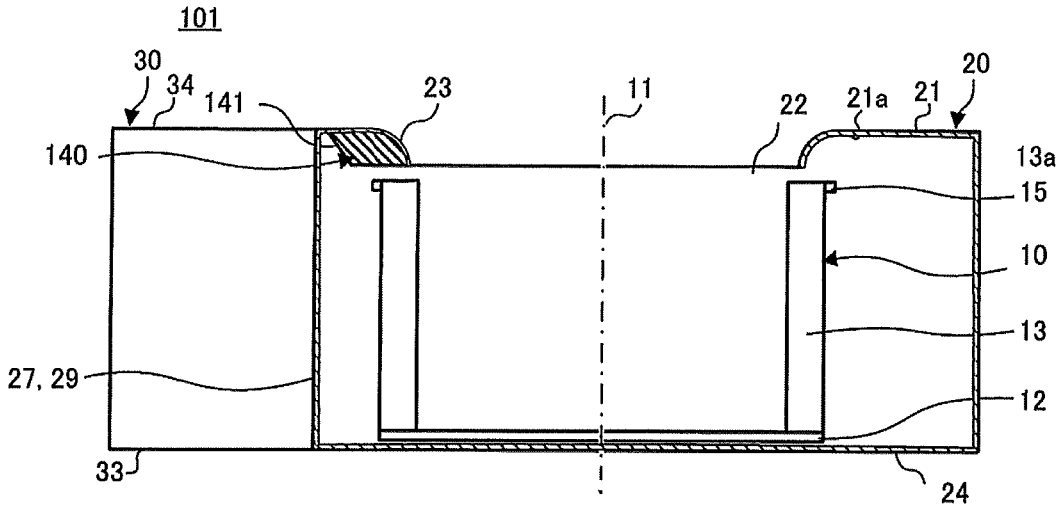
FIG. 7 is a longitudinal sectional view of a multiblade fan according to Embodiment 2 of the present invention.

FIG. 7 is a longitudinal sectional view of a multiblade fan according to Embodiment 2 of the present invention. FIG. 7 illustrates a section of a multiblade fan 101 taken along a plane parallel to the rotary shaft 11 in the impeller 10. In Embodiment 2, the shape of a block side wall 141 of a flow regulating block 140 differs from that in Embodiment 1. In Embodiment 2, items not specifically described are similar to those in Embodiment 1. The same functions and components as those in Embodiment 1 are designated by the same reference signs in the following description.

The reentering flow from the duct 30 to the tongue 29 moves adjacent to the circumferential wall 27 while passing through the space between the block side wall 141 and the circumferential wall 27 including the tongue 29. Consequently, a slow-flowing area, in which the air flows at a low velocity, is formed near connection between the block side wall 141 and the first end face 21. In Embodiment 1, the block side wall 41 is parallel to the rotary shaft 11. This arrangement provides a wide space between the flow regulating block 40 and the circumferential wall 27 but forms a sharp corner at the connection between the block side wall 41 and the first end face 21. Consequently, the air flowing radially outward from the impeller 10 fails to flow along the corner, thus forming a slow-flowing area near the block side wall 41. In such a slow-flowing area, the air flow loses energy, leading to an increase in pressure loss.

As in Embodiment 1, the flow regulating block 140 in Embodiment 2 is disposed on the inner surface 21*a* of the first end face 21 and extends along the bell mouth 23 of the first end face 21 such that the flow regulating block 140 is located in a range of a predetermined angle from the reference line P. In Embodiment 2, the block side wall 141 facing the circumferential wall 27 slopes toward the rotary shaft 11. For example, the flow regulating block 140 reduces its thickness along the rotary shaft 11, or its height from the inner surface 21*a*, gradually away from the impeller 10, or radially outward.

The block side wall 141 sloping toward the rotary shaft 11 as described above provides a gentle corner formed by the flow regulating block 140 and the first end face 21 as compared with the corner in the configuration in which the block side wall 141 is parallel to the rotary shaft 11. In the multiblade fan 101 with such a configuration, an air flow flowing radially outward from the impeller 10 moves along the sloping block side wall 141 and flows through the space between the block side wall 141 and the circumferential wall 27. A slow-flowing area formed near the block side wall 141 by a reentering air flow is reduced by the air sent out of the impeller 10 and flowing along the block side wall 141, thus further enhancing a rise in static pressure in the multiblade fan 101.

The block side wall 141 may slope at a position at which the distance between the bell mouth 23 and the circumferential wall 27 is long, or a position remote from the tongue 29, and may have no slope or may slope at a slight angle at a position at which the distance between the bell mouth 23 and the circumferential wall 27 is short, or a position close to the tongue 29. Such a configuration of the multiblade fan 101 ensures that a space through which air flows is formed between the flow regulating block 140 and the circumferential wall 27.

As described above, the block side wall 141, which faces the circumferential wall 27, of the flow regulating block 140 in Embodiment 2 slopes toward the rotary shaft 11 located in the impeller 10.

Consequently, the multiblade fan 101 allows the air flow sent out of the impeller 10 to move along the sloping block side wall 141, thus reducing or eliminating the slow-flowing area formed near the block side wall 141. Thus, the multiblade fan 101 allows the air flow reentering the fan casing 20 to stably flow through the space between the flow regulating block 140 and the circumferential wall 27, leading to improved air-sending performance.

Embodiment 3

Figure 8:
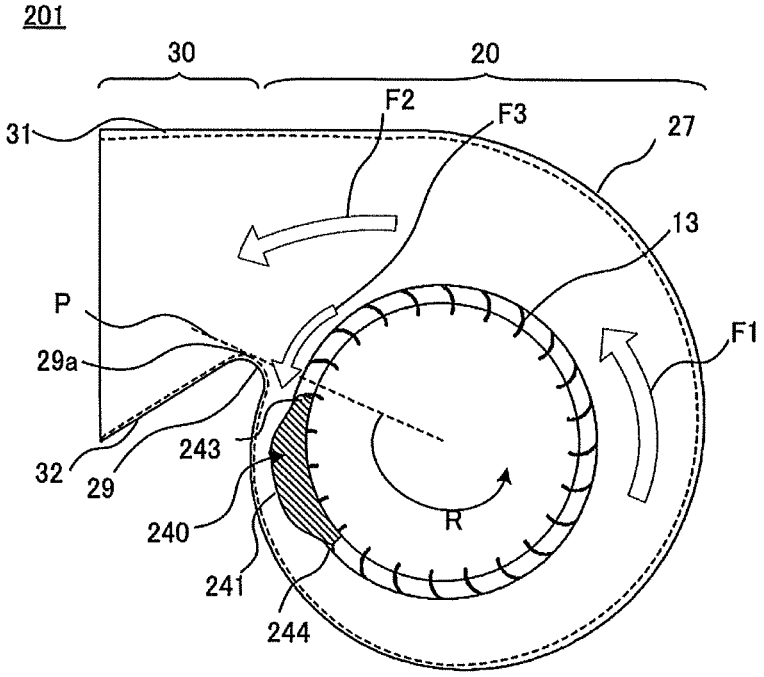
FIG. 8 is a cross-sectional view of a multiblade fan according to Embodiment 3 of the present invention.

FIG. 8 is a cross-sectional view of a multiblade fan according to Embodiment 3 of the present invention. FIG. 8 illustrates a cross-section of a multiblade fan 201 taken along a plane orthogonal to the rotary shaft 11 in the impeller 10. In Embodiment 3, the shape of a flow regulating block 240 differs from that in Embodiment 1. In Embodiment 3, items not specifically described are similar to those in Embodiment 1. The same functions and components as those in Embodiment 1 are designated by the same reference signs in the following description.

As in Embodiment 1, the flow regulating block 240 in Embodiment 3 is disposed on the inner surface 21*a* of the first end face 21 and extends along the bell mouth 23 of the first end face 21 such that the flow regulating block 240 is located in a range of a predetermined angle from the reference line P. In Embodiment 1, the flow regulating block 40 has substantially identical cross-sections regardless of the angle of rotation from the reference line P. In Embodiment 3, the distance between the rotary shaft 11 and a block side wall 241 facing the circumferential wall 27 in the radial direction varies depending on the angle of rotation from the reference line P. For example, middle part of the block side wall 241 between an upstream or leading end 243 and a downstream or trailing end 244 of the flow regulating block 240 protrudes toward the circumferential wall 27. In other words, the distance between the block side wall 241 and the rotary shaft 11 gradually increases in the rotation direction away from the reference line P. After the distance reaches a predetermined value, the distance gradually decreases. In such a case, a space between the block side wall 241 and the circumferential wall 27 gradually becomes narrower in a direction away from the tongue 29 and then gradually becomes wider.

In the multiblade fan 201 with such a configuration, a reentering flow of air from the duct 30 to the tongue 29 flows into the space, which is wide near the tongue 29, between the circumferential wall 27 and the flow regulating block 240. Since the space gradually increases toward the downstream end of the block, the reentering flow slows down while passing through the space, so that dynamic pressure is converted into static pressure.

At a position with the narrowest space between the circumferential wall 27 and the block side wall 241, the distance L between the block side wall 241 and the downstream end of the bell mouth 23 is preferably set in the range of, for example, approximately 0.4 to approximately 0.8, as illustrated in FIG. 4.

As described above, in Embodiment 3, the distance between the rotary shaft 11 and the block side wall 241, which faces the circumferential wall 27, of the flow regulating block 240 gradually increases in the rotation direction (arrow R direction) away from the reference position (reference line P) and then is constant or gradually decreases.

This shape facilitates entry of the reentering flow (represented by the arrow F3) into the space, which is wide near the tongue 29, between the circumferential wall 27 and the flow regulating block 240. In addition, the space gradually widens toward the downstream end of the flow regulating block 240, leading to a rise in static pressure. Therefore, the multiblade fan 201 allows the reentering flow to stably flow through the space between the circumferential wall 27 and the flow regulating block 240, leading to improved air-sending performance.

Embodiment 4

Figure 9:
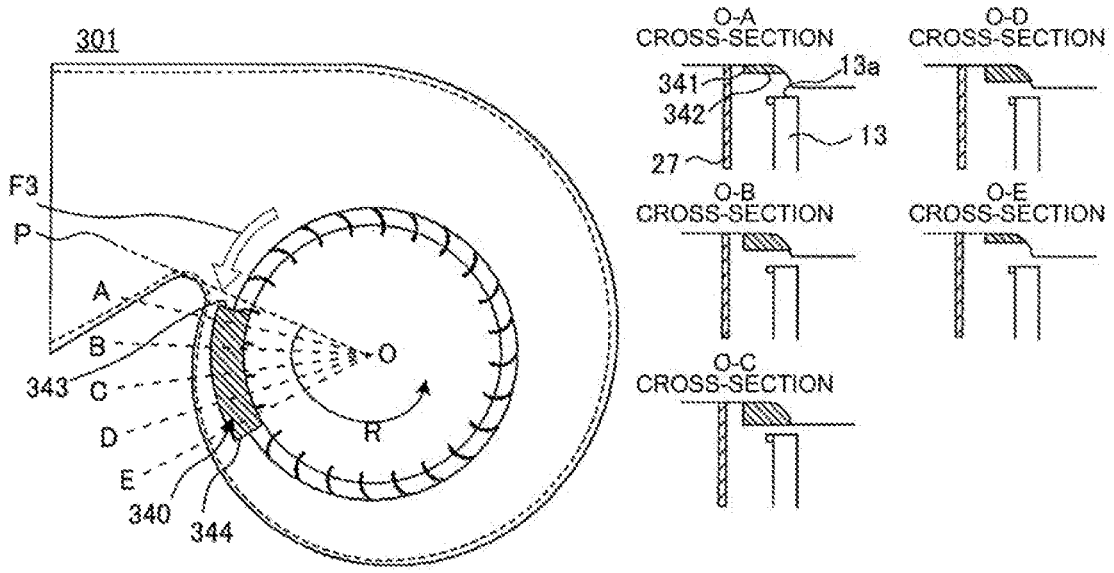
FIG. 9 includes a cross-sectional view of a multiblade fan according to Embodiment 4 of the present invention.

FIG. 9 includes a cross-sectional view of a multiblade fan according to Embodiment 4 of the present invention. FIG. 9 illustrates longitudinal sections of a multiblade fan 301 taken along planes parallel to the rotary shaft 11 in the impeller 10. In Embodiment 4, the shape of a block bottom surface 342 of a flow regulating block 340 differs from that in Embodiment 1. In Embodiment 4, items not specifically described are similar to those in Embodiment 1. The same functions and components as those in Embodiment 1 are designated by the same reference signs in the following description.

As in Embodiment 1, the flow regulating block 340 in Embodiment 4 is disposed on the inner surface 21*a* of the first end face 21 and extends along the bell mouth 23 of the first end face 21 such that the flow regulating block 340 is located in a range of a predetermined angle from the reference line P. In Embodiment 1, the flow regulating block 40 has substantially identical cross-sections regardless of the angle of rotation from the reference line P. In Embodiment 4, the distance between the first end face 21 and the block bottom surface 342 facing the impeller 10 varies depending on the angle of rotation from the reference line P. For example, middle part of the block bottom surface 342 between an upstream or leading end 343 and a downstream or trailing end 344 of the flow regulating block 340 protrudes toward the distal ends 13*a* of the blades 13. Specifically, the distance between the block bottom surface 342 and the first end face 21 gradually increases in the rotation direction (arrow R direction) away from the reference line P. After the distance reaches a predetermined value, the distance is constant or gradually decreases.

Right part of FIG. 9 includes longitudinal sections of the flow regulating block 340 at positions obtained by rotating the reference line P about the rotary shaft 11. The sections, that is, an O-A section, an O-B section, an O-C section, an O-D section, and an O-E section are arranged in the order of increasing angle of rotation from the reference line P. In the O-A section located upstream of the other sections in the air flow direction, the flow regulating block 340 has a low height. In the O-C section, the flow regulating block 340 has a maximum cross-section. At positions downstream of the O-C section in the air flow direction, or positions corresponding to the O-D section and the O-E section, the height of the flow regulating block 340 is again lowered.

In the multiblade fan 301 with such a configuration, the amount of protrusion of the flow regulating block 340 from the inner surface 21*a* is small near the tongue 29. This configuration prevents the reentering flow (represented by the arrow F3) from the duct 30 to the tongue 29 from hitting the flow regulating block 340 when entering the space. In addition, since the distance between the block bottom surface 342 and the first end face 21 gradually decreases toward the downstream end of the block, a change in area of the passage is suppressed at a position at which the reentering flow enters the fan casing 20 through the space, or at the trailing end 344.

In Embodiment 4, the distance between the block bottom surface 342, which faces the distal ends 13*a* of the plurality of blades of the impeller 10, of the flow regulating block 340 and the inner surface 21*a* of the first end face 21 gradually increases in the rotation direction (arrow R direction) away from the reference position (reference line P) and then is constant or gradually decreases.

Such a configuration of the multiblade fan 301 reduces impact of the reentering flow against the flow regulating block 340 in the vicinity of the upstream end of the flow regulating block 340, thus reducing pressure loss due to the impact. Additionally, the multiblade fan 301 achieves a reduction in pressure loss due to a sudden increase in area of the passage in the vicinity of the downstream end of the flow regulating block 340. As described above, the reentering flow easily flows into the space between the flow regulating block 340 and the circumferential wall 27 and easily flows out of the space, thus enhancing a rise in static pressure in the multiblade fan 301. This leads to improved air-sending performance of the multiblade fan 301.

Embodiment 5

Figure 10:
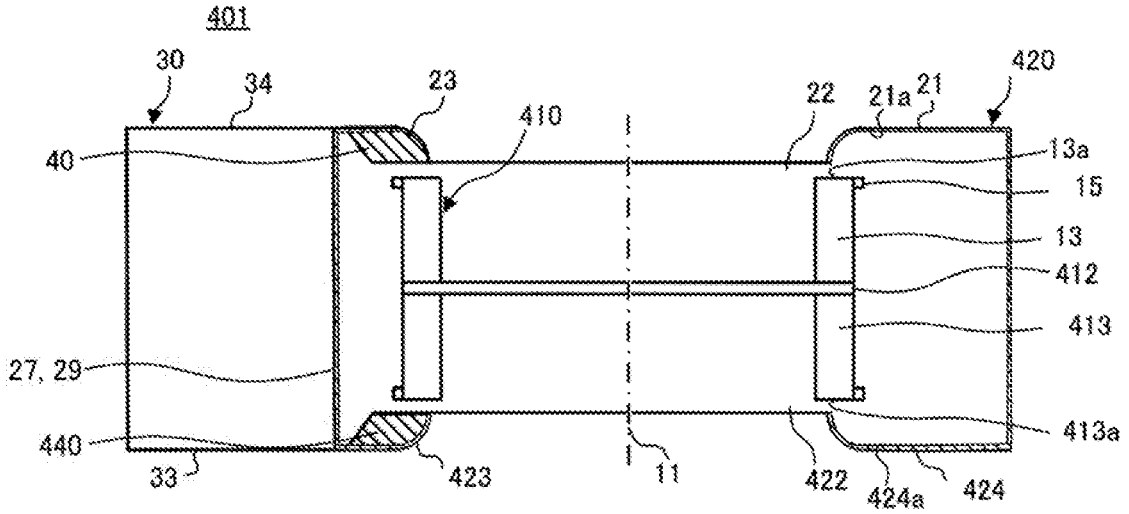
FIG. 10 is a longitudinal sectional view of a multiblade fan according to Embodiment 5 of the present invention.

FIG. 10 is a longitudinal sectional view of a multiblade fan according to Embodiment 5 of the present invention. The multiblade fans according to Embodiments 1 to 4 are of a single suction type in which the inlet 22 is provided only in one face (first end face 21) of the fan casing. A multiblade fan 401 according to Embodiment 5 is a double suction type multiblade fan further having an inlet 422 disposed in another face (second end face 424) of a fan casing 420. In Embodiment 5, items not specifically described are similar to those in Embodiment 2. The same functions and components as those in Embodiment 2 are designated by the same reference signs in the following description.

In the multiblade fan 401 according to Embodiment 5, the blades 13 extend from a first surface of a rotating plate 412, and blades 413 similarly extend from a second surface of the rotating plate 412. The blades 413 are circumferentially arranged at predetermined intervals about the rotary shaft 11. Like the first end face 21, the second end face 424 has the inlet 422 formed by a bell mouth 423. In other words, the multiblade fan 401 has substantially symmetrical configurations on both the surfaces of the rotating plate 412.

Like the first end face 21, the second end face 424 has a flow regulating block 440 disposed on an inner surface 424*a* thereof. The flow regulating block 440 extends along the bell mouth 423 of the second end face 424 such that the flow regulating block 440 is located in a range of a predetermined angle (for example, 120 degrees) from the reference line P (refer to FIG. 2). Although the flow regulating blocks provided on both the first end face 21 and the second end face 424 have been described above, the flow regulating block may be provided on only one of the first end face 21 and the second end face 424. Furthermore, the shape and the attachment range of the flow regulating block in any of Embodiments 1 to 4 may be used as those of the flow regulating block 40 and the flow regulating block 440 in Embodiment 5.

As described above, in Embodiment 5, an impeller 410 further includes the second blades 413 extending from the second surface of the rotating plate 412 opposite from the surface from which the blades 13 extend. The blades 413 are circumferentially spaced about the rotary shaft 11. The fan casing 420 has the second end face 424 located adjacent to distal ends 413*a* of the second blades 413. The second end face 424 has the inlet 422 and the bell mouth 423. The flow regulating block (the flow regulating block 40, the flow regulating block 440) is provided on at least one of the first end face 21 and the second end face 424.

Such a configuration of the multiblade fan 401, which is of the double suction type with multiple inlets (the inlet 22 and the inlet 422), enhances a rise in static pressure, leading to improved air-sending performance. Although an air flow through the multiblade fan 401 of the double suction type differs from that of the single suction type, the multiblade fan 401 can reduce pressure loss due to the reentering flow on both the first end face 21 and the second end face 424 by using the flow regulating block 40 and the flow regulating block 440.

Embodiments of the present invention are not limited to those described above, and can be modified in a variety of ways. For example, the flow regulating block and the fan casing may be molded in one piece. Alternatively, the flow regulating block may be molded in a separate part and be fastened to the fan casing by, for example, bonding or using a bolt. If the flow regulating block 40 is formed as a separate part, the block can be easily attached to the fan casing 20 because it is unnecessary to change the shape of the fan casing as in the related art.

Figure 11:
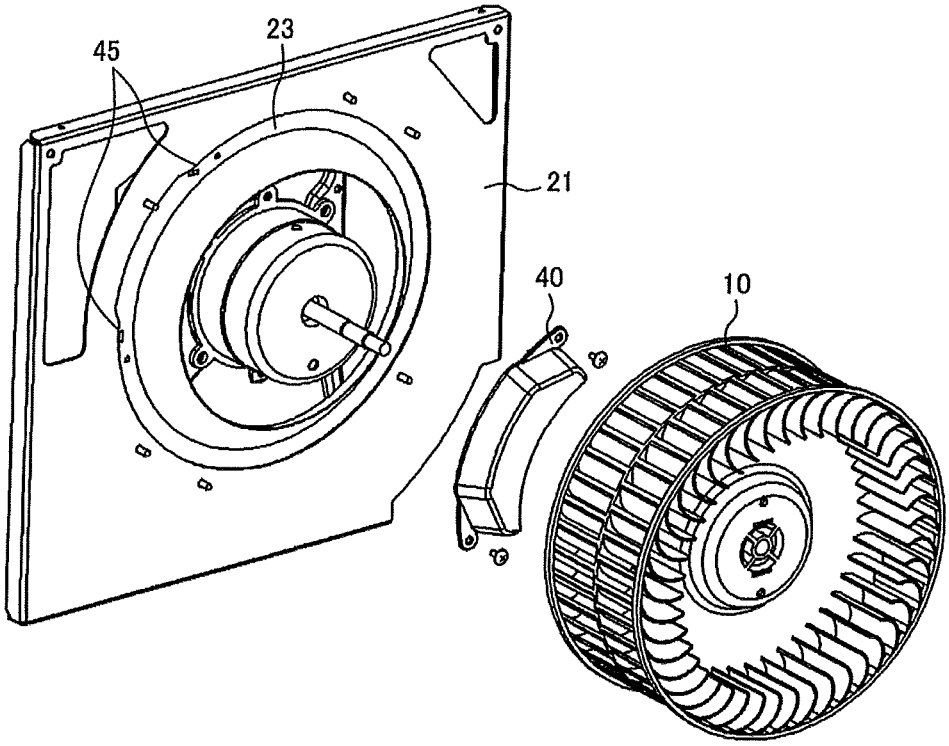
FIG. 11 is an exploded perspective view illustrating a first end face, a flow regulating block to be attached to the first end face, and an impeller.
Figure 12:
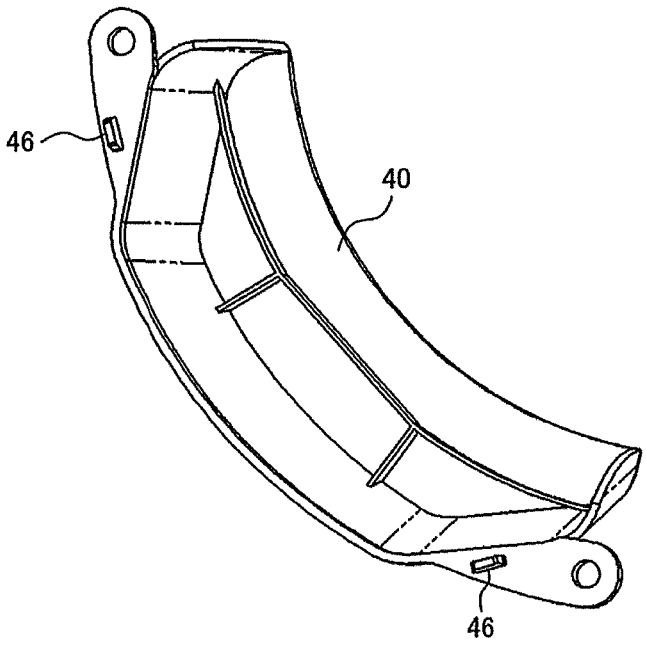
FIG. 12 is a perspective view of the flow regulating block as viewed from a side adjacent to the first end face.

Specifically, assuming that the flow regulating block 40 is formed as a separate part, the following configuration facilitates attachment of the flow regulating block to the fan casing 20. FIG. 11 is an exploded perspective view illustrating the first end face 21, the flow regulating block 40 to be attached to the first end face 21, and the impeller 10. A driving motor for driving the impeller 10 is attached to the first end face 21. The first end face 21 has a plurality of slits 45 for positioning the flow regulating block 40. FIG. 12 is a perspective view of the flow regulating block 40 as viewed from a side adjacent to the first end face 21. The flow regulating block 40 is molded from sheet metal or resin. The flow regulating block 40 includes positioning protrusions 46 arranged to fit into the slits 45. The flow regulating block 40 can be easily attached to the first end face 21 such that the protrusions 46 are fitted into the slits 45 and the flow regulating block 40 is fastened to the first end face 21 with screws.

REFERENCE SIGNS LIST

1, 101, 201, 301, 401 multiblade fan 10, 410 impeller 11 rotary shaft 12, 412 rotating plate 13, 413 blade 13*a*, 413*a* distal end of the blade 15 coupler 20, 420 fan casing 21 first end face 21*a* inner surface of the first end face 22, 422 inlet 23, 423 bell mouth 24, 424 second end face 27 circumferential wall 27*a* end 27*b* end 29 tongue 29*a* tip 30 duct 31 extension plate 32 diffuser plate 33 duct bottom plate 34 duct top plate 35 outlet 40, 140, 240, 340, 440 flow regulating block 41, 141, 241 block side wall 42, 342 block bottom surface 43, 243, 343 leading end 44, 244, 344 trailing end 424*a* inner surface of the second end face L distance P reference line α1, α2 angle 45 slit 46 protrusion

The invention claimed is:

1. A multiblade fan comprising:

an impeller including a rotating plate secured to a rotary shaft and a plurality of blades extending from a surface of the rotating plate and circumferentially spaced about the rotary shaft;

a fan casing containing the impeller, the fan casing having a circumferential wall facing a periphery of the impeller and a first end face disposed adjacent to distal ends of the plurality of blades, the circumferential wall extending at an increasing distance from the rotary shaft in a rotation direction of the impeller, the first end face having an inlet through which air flows into the fan casing;

a duct connected to a downstream end of the fan casing in an air flow direction, the duct having an outlet through which the air from the fan casing is discharged; and a flow regulating block disposed on an inner surface of the first end face and regulating a flow of the air, wherein the duct includes a diffuser plate extending from an upstream end of the circumferential wall in the air flow direction and the diffuser plate extends in the rotation direction outwardly in a radial direction of the impeller, wherein the circumferential wall includes a tongue that is bent part of the upstream end and the tongue is connected to the diffuser plate, wherein the first end face has a bell mouth provided at the inlet and the bell mouth protrudes into the fan casing, wherein the flow regulating block is spaced from the circumferential wall, the flow regulating block extends along the bell mouth in the rotation direction, and the flow regulating block is located downstream from a reference position on a line connecting the rotary shaft to a tip of the tongue such that a leading end of the flow regulating block is downstream from the reference position an angle of rotations from the line to the leading end is 0 degrees or more, a trailing end of the flow regulating block is downstream from the reference position, and an angle of rotation from the line to the trailing end is 120 degrees or less, and wherein the flow regulating block is in contact with a curved portion of the bell mouth.

2. The multiblade fan of claim 1, wherein the flow regulating block has a block side wall facing the circumferential wall and the block side wall slopes toward the rotary shaft of the impeller.

3. The multiblade fan of claim 1, wherein the leading, end of the flow regulating block is closer to the tongue than the trailing end of the flow regulating block, the leading end is in a range of an angle of 5 to 40 degrees from the reference position, and the trailing end is in a range of an angle of 60 to 120 degrees from the reference position.

4. The multiblade fan of claim 1, wherein a block side wall of the flow regulating block faces the circumferential wall and the flow regulating block is shaped such that a distance between the block side wall and the rotary shaft gradually increases in the rotation direction away from the reference position and then is constant or gradually decreases.

5. The multiblade fan of claim 1, wherein the flow regulating block has a block bottom surface facing a distal end of any of the plurality of blades of the impeller, d is shaped such that a distance between the block bottom surface and the inner surface of the first end face gradually increases in the rotation direction away from the reference position and then is constant or gradually decreases.

6. The multiblade fan of claim 1, wherein the impeller further includes a plurality of second blades extending from a second surface of the rotating plate opposite from the s face from which the plurality of blades extend, and the plurality of second blades are circumferentially spaced about the rotary shaft, wherein the fan casing further has a second end face disposed adjacent to distal ends of the plurality of second blades and the second end face has an inlet and a bell mouth, and wherein the flow regulating block is disposed on at least one of the first end face and the second end face.

7. The multiblade fan of claim 1, wherein the tongue has a predetermined radius of curvature.

8. The multiblade fan of claim 7, wherein the predetermined radius of curvature of the tongue is constant along the direction of the rotary shaft.

9. The multiblade fan of claim 7, wherein the predetermined radius of curvature of the tongue varies along the direction of the rotary shaft.

10. The multiblade fan of claim 1, wherein the flow regulating block has a dimension along the direction of the rotary shaft, and the dimension is substantially equal to the distance between an inner surface of the first end face and a downstream end of the bell mouth.

* * * * *